United States Patent [19]

Kosner, Jr. et al.

[11] Patent Number: 4,483,633

[45] Date of Patent: Nov. 20, 1984

[54] MATRIX PRINT HEAD PRINTER

[75] Inventors: Jerry J. Kosner, Jr., LaGrange; Michael Wisniewski, Bolingbrook; Tom Faber, Skokie, all of Ill.

[73] Assignee: Bell & Howell Company, Chicago, Ill.

[21] Appl. No.: 467,628

[22] Filed: Feb. 18, 1983

[51] Int. Cl.[3] ..... B41J 3/54; B41J 3/12; B41J 13/08

[52] U.S. Cl. ..... 400/82; 101/47; 400/124; 400/196.1; 400/629; 400/649

[58] Field of Search ..... 400/48, 82, 629, 124, 400/649, 652, 653, 194, 601, 635, 636; 101/47, 93.05

[56] References Cited

U.S. PATENT DOCUMENTS

| | | | |
|---|---|---|---|
| 2,400,226 | 5/1946 | Euth | 400/616.2 X |
| 3,837,461 | 9/1974 | Waibel | 400/124 X |
| 3,942,620 | 3/1976 | Dillinger et al. | 400/124 |
| 4,056,183 | 11/1977 | Beery | 400/124 |
| 4,165,188 | 8/1979 | Rempel | 400/248 X |
| 4,255,061 | 3/1981 | Beery | 400/124 |
| 4,386,860 | 6/1983 | Price et al. | 400/124 |
| 4,397,574 | 8/1983 | Wojdyla | 400/196.1 |

*Primary Examiner*—Paul T. Sewell

*Attorney, Agent, or Firm*—Howard B. Rockman; Neal C. Johnson; Alan H. Haggard

[57] ABSTRACT

A matrix printing apparatus of the type having a path for sequentially transporting a series of documents to be printed between a plurality of dot matrix ballistic print heads and back-up platen rollers opposite each print head, the dot matrix ballistic print heads adapted, when actuated, to simultaneously impact an ink source and one side of each document as each document passes the print heads to apply printed material to each document in a pre-programmed array. The improvement of the present invention comprises moving the back-up platen rollers from a first position adjacent the print head when the print head is actuated, to a second position at a distance from the print head when the print head is not actuated. The matrix printing apparatus also includes an ink source comprising an endless inked ribbon which continually moves between the dot matrix ballistic print heads and the document path, and includes an ink guard disposed between the inked ribbon and the document path, the ink guard having relatively small apertures therein adjacent each print head wherein only the portion of the ribbon adjacent each print head extends through each corresponding aperture and contacts each document during application of printed material to each document.

23 Claims, 7 Drawing Figures

MATRIX PRINT HEAD PRINTER

The present invention relates generally to a dot matrix print head printing apparatus, and in particular to an improved adjustable roller back-up platen system for the matrix print heads and a novel print mask or guard which prevents smearing or streaking of a document as it passes through the printing apparatus.

BACKGROUND OF THE INVENTION

Several different types of dot-matrix document printers are in common use in the prior art, including apparatus to print names and addresses on envelopes as the envelopes pass adjacent a series of printing heads. A primary purpose of such apparatus is to transport the document through the printing station at high speeds to increase the rate of production and efficiency of the operation. One such document printer is generally referred to as an ink jet printer, wherein particles of ink are deposited on the surface of the document by a series of jets formed in a matrix at the printing station, whereby the pattern developed by the matrix to form each letter is controlled electronically by a microprocessor, or other similar device. The complexity and cost of ink jet printing systems makes them prohibitive for use by smaller business operations with minimal or moderate printing demands.

Another type of dot-matrix printing system which is more compatible with smaller business operations having less printing requirements utilizes a series of staggered dot matrix print heads past which a series of documents to be printed are constantly moving at relatively high speed. Each printing head consists of a series of linearly-disposed matrix wires which sequentially impact an ink ribbon and a document passing the print head pursuant to a pre-set program to form letters on the document. The print heads are controlled by a character generator program which generates letters upon contact with the moving document. Certain of such print heads employ solenoids with moving cores attached to the matrix wires, while other systems use electromagnets to activate small hammers that ballistically propel the print wires towards the inked ribbon and then into contact with the document to be printed. An example of the latter described dot print head is marketed by Lear Siegler under the name Ballistic (TM) Matrix Print Head, and is illustrated in conjunction with the preferred embodiment of the present invention. However, it is to be understood that other matrix print heads can be utilized in the disclosed apparatus without varying from the scope of the inventive concepts embodied therein.

Each matrix print head utilized in the present invention comprises a series of wires disposed linearly adjacent the printing end of the head. The other end of each wire extends to one of a series of solenoid coils which are independently actuated responsive to electrical impulses transmitted by a pre-set signal generator, such as a microprocessor. In accordance with the pre-set printing program, a series of impulses are transmitted to selected solenoids, and the wires associated with each activated solenoid are propelled forward. The tip of each wire impacts an inked ribbon before contacting the document surface to be printed. The document moves constantly past the print head, and the sequence and number of wires impacting the document through the inked ribbon forms the letters and characters on the document surface.

As the wires in the print matrix head are propelled forward under the influence of the solenoids, a back-up element must be provided adjacent the side of the document opposite the printed side to arrest the forward movement of the pins. Without such back-up, the pins would be prone to pierce the ribbon and the document upon impact. Certain prior devices have utilized a flat bar opposite the print heads, which receives the impact of the print head wires. However, this means of providing a back-up for the print head wires introduces an inefficient factor into the operation of the printing apparatus. As mentioned previously, the printing device of the present invention is designed to rapidly print an address or other indicia on a document, where the document is constantly moving at high speed along a path past the print heads. The document slides across the flat back-up bar of certain of the prior devices, whereby friction tends to slow down the movement of the document.

The matrix print heads are pre-programmed to create letters and characters on a document which is moving at a pre-selected, uniform rate consistent with printing speed past the print heads. If the document speed is altered as it passes the print heads, the address can possibly be applied non-uniformly to the document, whereby one letter or character may be formed on top of another. If one side of the document must pass over a stationary bar, the friction between the bar and the document may cause the document to pass the print heads at an intermittent rather than uniform speed, causing uneven application of printed material on the document.

In addition, certain prior dot matrix printing apparatus of the type disclosed herein utilize an inked ribbon which directly contacts a broad portion of the document to be printed. The ink tends to smear or streak the document adjacent the print head since the ribbon is sequentially and repeatedly moved toward the document by the print head wires.

The above-noted defects have materially reduced the efficiency, workability, and commercial acceptance of certain prior dot matrix print systems. An object of the present invention, therefore, is to provide a novel roller platen back-up system for ballistic dot matrix printers which provide the requisite back-up for the wire print heads while at the same time providing an entry gap for moving the document past the print heads with the least amount of obstruction.

A further object of the present invention is to provide a roller platen back-up system for a dot-matrix printer which will not impede or otherwise interfere with the rapid and constant movement of a document through the printing apparatus.

Yet another object of the present invention is to provide a back-up system for a dot matrix printer which can handle documents of intermixed thicknesses without the necessity of making adjustments to the back-up system.

Yet another object of the present invention is to provide a mask or guard between the inked ribbon and document to be printed by a dot matrix printer to prevent streaking or smearing of the document during the printing operation.

These and other objects and features accomplished by the present invention will be better understood with reference to the following summary of the invention, drawings, and detailed description thereof.

SUMMARY OF THE INVENTION

A matrix printing apparatus is provided of the type having a path for sequentially transporting a series of documents to be printed between a plurality of vertically staggered, horizontally spaced dot matrix ballistic print heads and back-up platen rollers located opposite each print head, including feed belts to transport each document along the path, each print head adapted, when actuated, to simultaneously impact an ink source and one side of each document as each document passes the print heads to apply printed material to each document in a pre-programmed array and to also impact upon the back-up platen rollers during the printing operation, the improvement comprising selectively moving the back-up platen rollers from a first position immediately adjacent the corresponding print head when the print head is actuated, to a second position at a distance from the corresponding print head when the print head is not actuated, such that the back-up platen rollers are removed from the document transport path when the print heads are not applying printed material to each document, thereby providing an unobstructed path for document entry into each print station.

In addition, an apertured ink guard is provided between the ink source and the document path to ensure that only the poftion of an inked ribbon which is immediately adjacent the print heads comes into contact with the document during actuation of the print heads. This prevents smearing and streaking of the moving documents by adjacent portions of the inked ribbon.

The present invention further provides for vertical movement of a first carriage supporting the dot matrix ballistic print heads, ink source, and document feed belts on one side of the document path, and of a second carriage on the other side of the document path supporting the back-up platen rollers located adjacent the print heads and the back-up rollers for the document feed function located adjacent the document feed belts, to accommodate printing of documents of varying heights. The vertical movement of both carriages is independently mechanically coordinated by microprocessors or other suitable means to ensure that the back-up platen rollers are consistently in position opposite a corresponding print head at all vertical positions of the carriage supporting the print heads.

The present invention also provides for horizontal movement of the print head mounting carriage and its associated support frame to provide the proper pressure on the documents being transported along the document path, including pressure limit devices to prevent excessive pressure from being applied between the print heads and their associated back-up platen rollers. The horizontal movement of the carriage also allows the operator to clear paper jams in the print area, while the pressure limit devices protect the operator's hand in case the carriage is moved forward unknowingly.

DESCRIPTION OF THE PREFERRED EMBODIMENT

Figure 1:
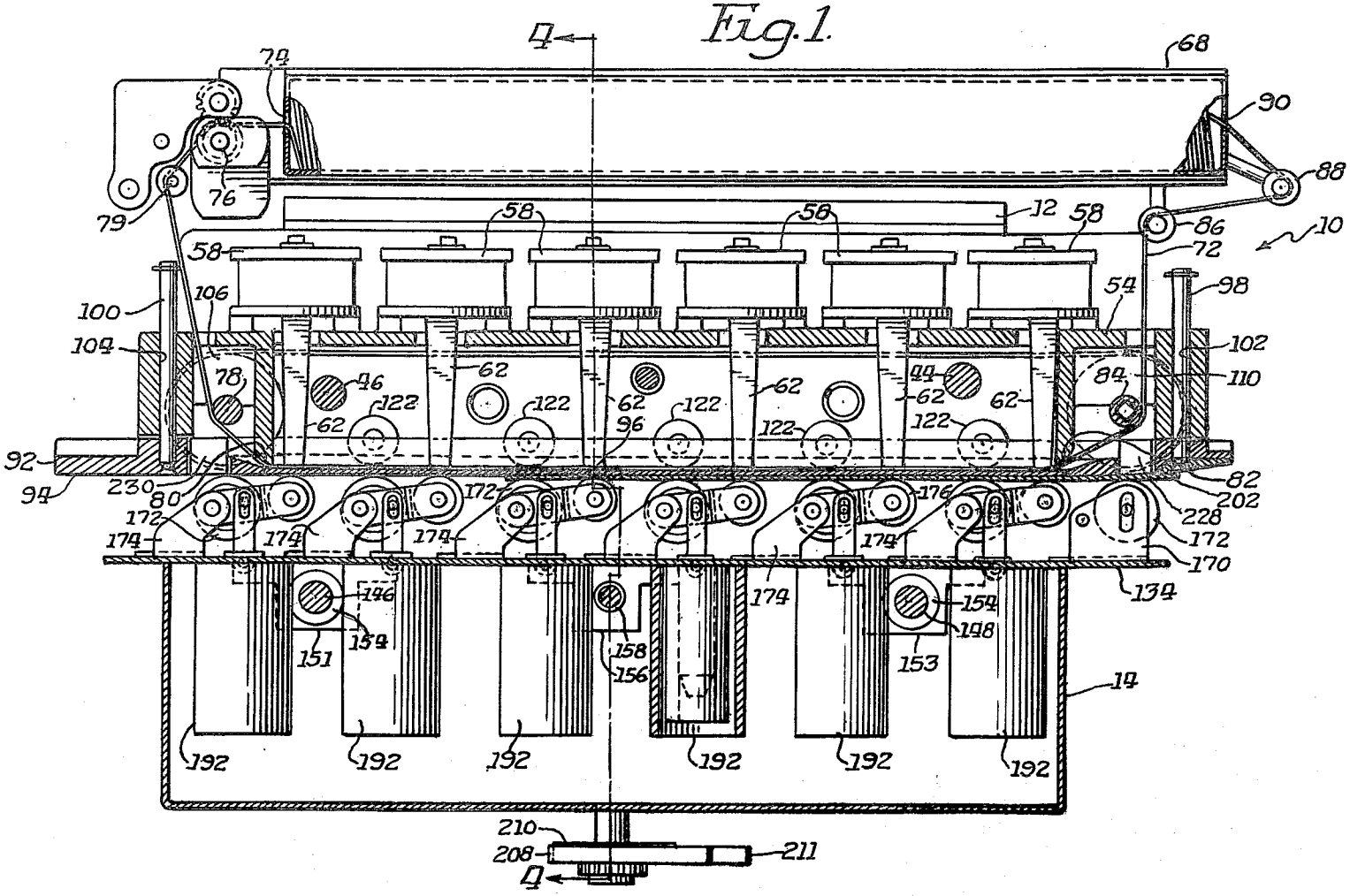
FIG. 1 is a cut-away top view of the printing apparatus according to the preferred embodiment of the subject invention, taken along line 1—1 of FIG. 4.
Figure 2:
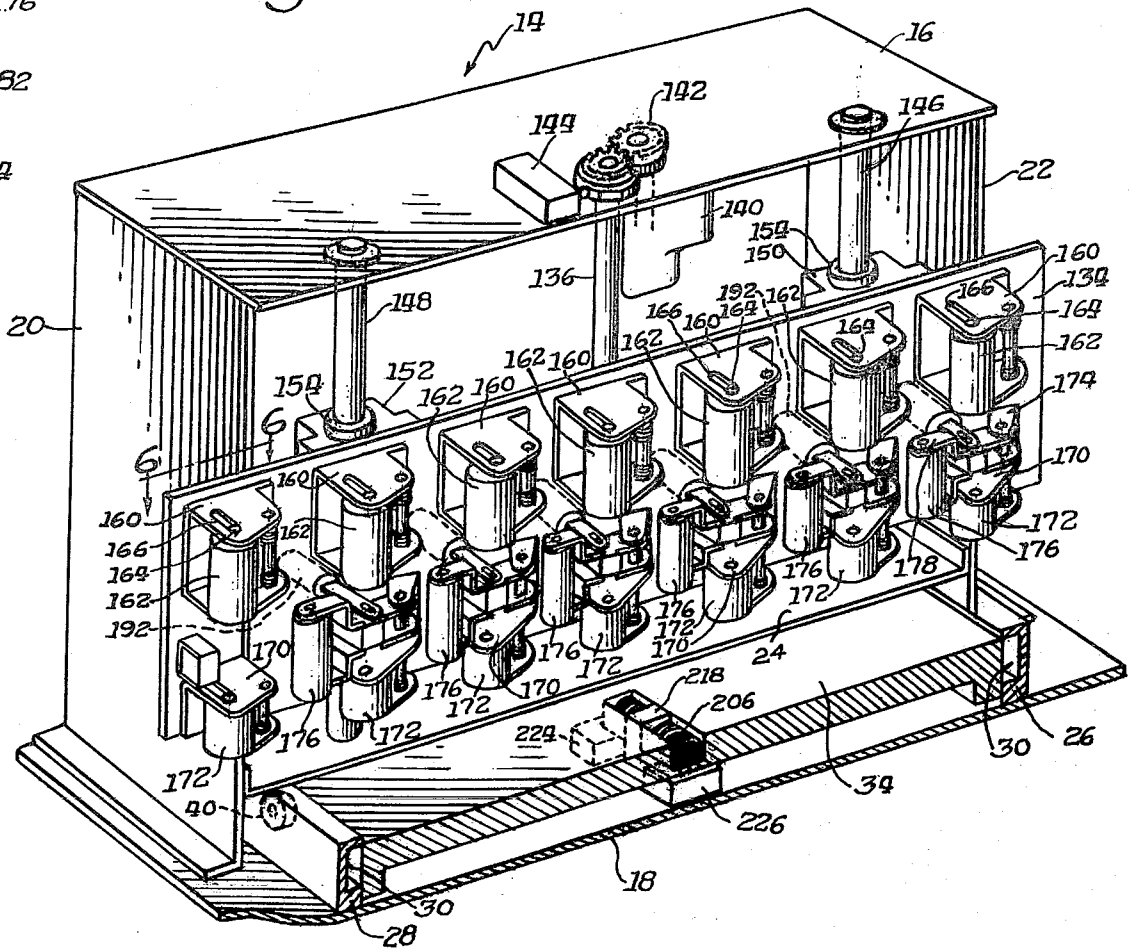
FIG. 2 is a frontal perspective view of the portion of the present invention comprising the support frame and vertically moveable carriage supporting the document guide rollers and the back-up platen rollers.
Figure 4:
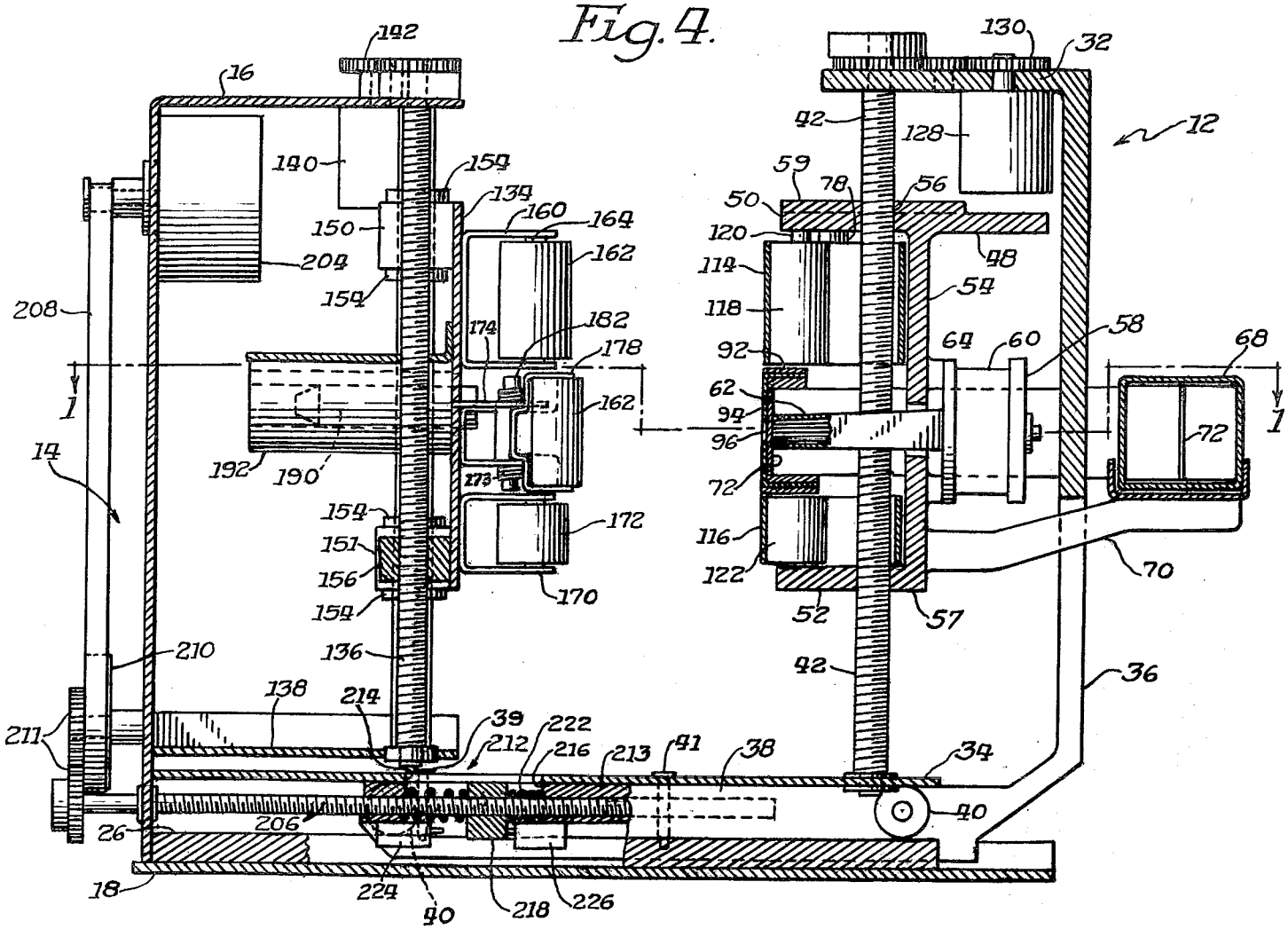
FIG. 4 is a cut-away side elevation view of the printing apparatus of the present invention, showing the relative positions of the back-up platen roller carriage, and the print head carriage, as supported by their respective frames, taken along line 4—4 of FIG. 1.

Referring to FIG. 1, a printing apparatus according to the present invention is shown generally at 10 and has a first movable frame 12 and a second stationery frame 14. As best seen in FIGS. 2 and 4, stationary frame 14 includes an upper horizontally extending plate 16 and a lower horizontally extending support plate 18 to which a pair of opposed vertically extending panels 20, 22 are affixed. A base plate 24 is disposed above support plate 18, and extends between vertical panels 20, 22. A pair of opposed tracks 26, 28 are located between support plate 18 and base plate 24, which comprise U-shaped channels 30 extending along the length thereof.

Figure 3:
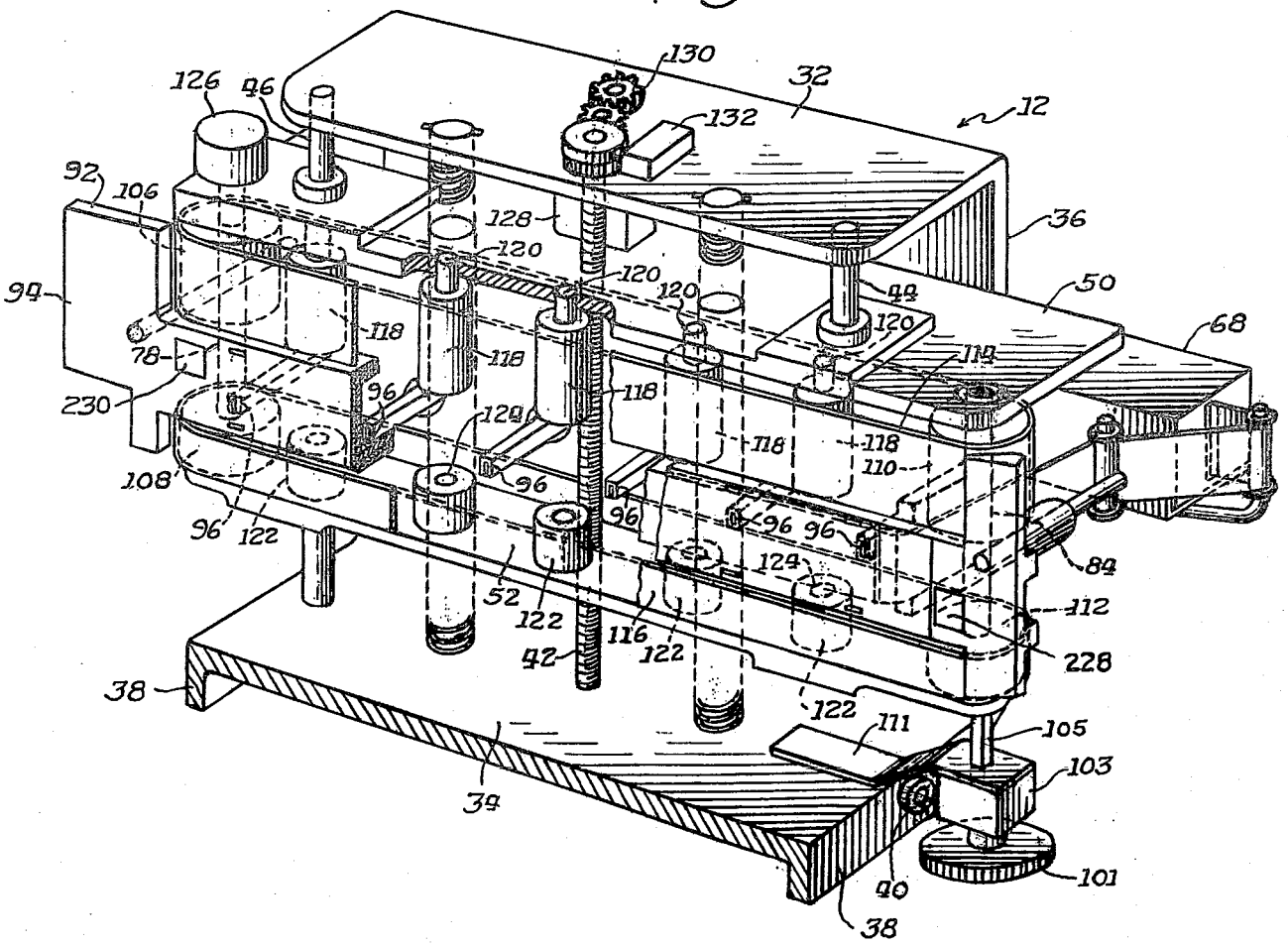
FIG. 3 is a frontal perspective view of the portion of the present invention comprising the support frame and vertically moveable carriage supporting the print heads and the document drive roller belts.

Referring to FIGS. 3 and 4, first movable frame 12 includes an upper horizontally extending plate 32 and a base plate 34, with a vertical plate 36 extending between horizontal plate 32 and base plate 34. A pair of flanges 38 extend downward from each side of base plate 34, and a plurality of casters 40 are rotatably mounted to flanges 38. As best seen in FIG. 4, base plate 34 of movable frame 12 is disposed in the space formed between base plate 24 and support plate 18 of stationary frame 14, and casters 40 ride in channels 30 formed in tracks 26, 28. Stop pins 39, 41 extend through base plate 34 and each channel 30 in tracks 26 to limit the lateral movement of movable frame 12 as casters 40 abut either stop pin 39 or 41. Thus, the location of stop pins 39, 41 define the width of the opening between frames 12 and 14. As will be explained, means are provided to move frame 12 relative to frame 14 as casters 40 ride in channels 30.

Referring next to FIGS. 3 and 4, a threaded shaft 42 and a pair of guide shafts 44, 46 extend between horizontal plate 32 and base plate 34 of movable frame 12. A print head carriage 48 is mounted on and supported by threaded shaft 42, and is adapted for vertical movement along guide shafts 44, 46 as will be explained. Carriage 48 comprises horizontally extending upper and lower plates 50, 52, and a vertically extending plate 54 between the upper and lower plates 50, 52 (FIG. 4). Threaded shaft 42 extends through threaded apertures 56, 57 and guide bushing 59 in plates 50, 52 respectively, whereby rotation of shaft 42 results in vertical displacement of carriage 48.

As best seen in FIGS. 1 and 4, a plurality of dot matrix ballistic print heads 58 of the type previously described are mounted on plate 54 of carriage 48. Each print head includes a solenoid housing 60, and a wire casing 62 which extends through apertures 64 in plate 54. Print wires 66 are disposed in casing 62 in a vertical configuration as previously described.

Referring to FIGS. 1 and 3, the preferred embodiment of the invention includes six print heads 58 spaced equally apart horizontally along plate 54. However, each successive print head 58 is staggered in the vertical dimension relative to the adjacent print head. In this manner, each print head 58 produces a separate line of printed characters on a document passing through the printer apparatus, as will be described.

A ribbon reservoir 68 is fixed to a pair of arms 70 which extend from carriage 48 to the outside of horizontally movable frame 12. An inked ribbon 72 is housed in reservoir 68, and is fed into the reservoir through a slit 74 in the reservoir by ribbon drive 76 (FIG. 1). Ribbon 72 exits reservoir 68 through a slit 90, and then passes around guide rollers 88 and 86 to shaft 84, which extends from upper plate 50 to lower plate 52 of print head carriage 48. Ribbon 72 then extends past a beveled flange 82 which extends outwardly from vertical plate 54 of carriage 48. Ribbon 72 then extends along the front of each print head casing 62 until it reaches a second beveled flange 80 at the opposite end of carriage 48. The vertical dimension of ribbon 72 is sufficient to enable portions of the ribbon to pass adjacent the front of each print head 58, which are staggered in the vertical dimension as previously described and as shown in FIG. 3. Ribbon 72 then passes around shaft 78 and guide roller 79 to ribbon drive 76, which feeds the ribbon back into reservoir 68 through slot 74.

To prevent excessive contact between the inked ribbon 72 and a document passing through the printer 10, an ink guard 92 is provided adjacent the outer face of inked ribbon 72. Referring to FIGS. 1, 3, and 4, ink guard 92 comprises a flat surface or face 94 which extends across print head carriage 48 and in front of the portion of ribbon 72 which extends between beveled flanges 80 and 82. A series of apertures 96 are disposed in face 94 of ink guard 92 at points immediately in front of the print heads 58, such that wires 66 can extend through aperture 96 and ink guard 92, as will be explained.

Ink guard 92 is slidably attached to carriage 48 by means of a pair of pins 98, 100 which are attached to either end of ink guard 92 and extend through guide slots 102, 104 in carriage 48. For purposes of replacing ribbon 72, ink guard 92 is moved manually away from the ribbon as rods 98, 100 slide in apertures 102, 104.

Figure 7:
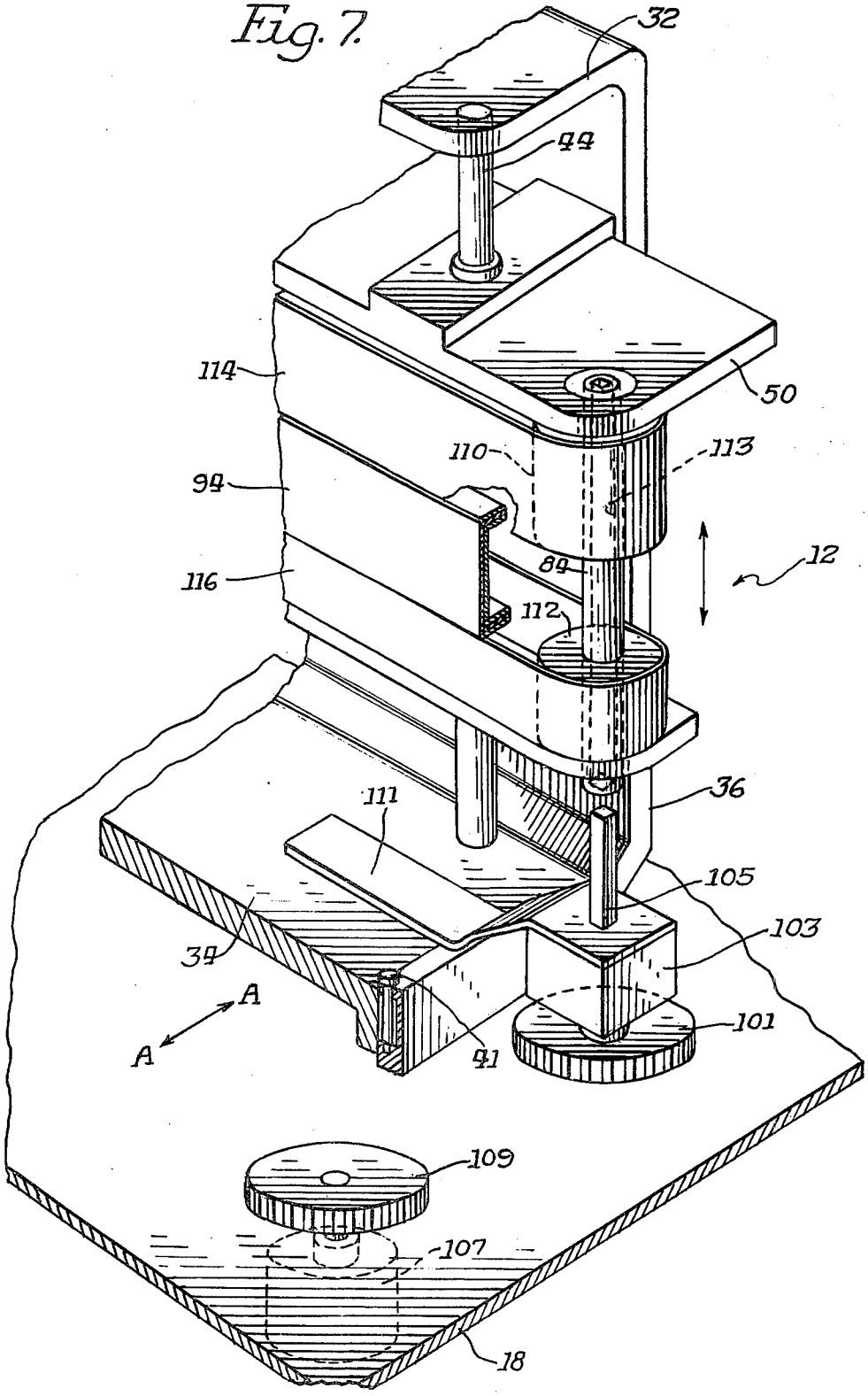
FIG. 7 is an exploded detail perspective view of the novel sliding mechanical connection between the drive means and the document transport system of the prevent invention.

Print head carriage 48 comprises means for transporting a document across the face of the carriage adjacent the ends of print heads 58. To this end, each shaft 78, 84 has mounted thereon a pair of coaxial rollers 106, 108 and 110, 112. Upper transport belt 114 extends around rollers 106 and 110, and lower transport belt 116 extends around rollers 108 and 112. Each belt 114, 116 extends in the same plane as face 94 of ink guard 92 when passing in front of carriage 48, as seen in FIG. 4. A series of intermediate rollers 118 are rotatably mounted by means of shafts 120 to upper plate 50 of carriage 48 and abut the interior surface of the front of belt 114 to maintain the straight line movement of the front surface of belt 114. In similar fashion, a series of intermediate rollers 122 are rotatably mounted by means of shafts 124 to base plate 52 of carriage 48. These rollers 122 abut the inner surface of the front of belt 116 to maintain straight line movement of the belt. Belts 114 and 116 are driven about rollers 106, 110 and 108, 112 by power delivered through gear 101 to bearing box 103 and shaft 105. Bearing box 103 is mounted on support plate 34 of print head carriage 48 by means of bracket 111. Shaft 105 fits inside shaft 84, and is capable of sliding inside shaft 84, as is shown in more detail in FIG. 7. Referring to FIG. 7, there is shown a drive motor 107 mounted on support plate 18, which drives a gear 109. As will be explained in detail, base plate 34 of movable frame 12 moves laterally with respect to support plate 18 in the direction indicated by arrow A-A in FIG. 7. As base plate 34 moves forward, towards stationary frame 14, gear 101 meshes with gear 109, thereby rotating shaft 105 through bearing box 103. Shaft 84 has a defined cross-sectional shaped bore 113 extending throughout the length thereof, which is adapted to slidably receive and mate with shaft 105, which has a cross-sectional shape corresponding to the shape of bore 113. In the preferred embodiment, bore 113 and shaft 105 are square shaped, however any other cross-sectional shape which enables shaft 105 to drive shaft 84 is suitable. As print head carriage 48 moves vertically with respect to frame 12, square shaft 105 slides in bore 113, and rotative motion is continually applied to shaft 84 at all vertical positions of print head carriage 48.

An impulse generator 126 is mounted on shaft 78 (FIG. 3) to monitor the speed of rotation of shaft 78, which necessarily is an indication of the speed at which a document moves along a path through printing apparatus 10. Electrical impulses are transmitted from generator 126 to a central control system (not shown) to coordinate document speed with the rate at which the print heads apply the characters to the face of the document.

A motor 128 is connected by gear train 130 to threaded shaft 42. In response to a control signal, motor 128 is activated causing shaft 42 to rotate and adjust the vertical position of carriage 48 and the entire printing apparatus mounted thereon. An impulse generator 132 is operably connected to gear train 130 to produce a series of electrical impulses responsive to the speed of rotation of shaft 42. These electrical impulses are transmitted to the control system for the printing apparatus, which regulates the vertical position of carriage 48 in a manner to be explained.

Positioned opposite print head carriage 48 is a roller carriage 134 mounted for vertical movement on stationary frame 14 (FIGS. 2, 4). To this end, threaded shaft 136 is mounted for rotation between plate 16 and shaft support plate 138 (FIG. 4). Motor 140 is affixed to plate 16 and drives a gear train 142 which is operably connected to shaft 136, whereby actuation of motor 140 imparts rotative motion to threaded shaft 136. An impulse generator 144 is disposed on plate 16 adjacent gear train 142 to monitor the speed of rotation of shaft 136, for purposes to be described.

A pair of smooth guide shafts 146, 148 also extend between plates 16 and 138 on either side of shaft 136. Bearing blocks 150, 151, 152, 153 are mounted for vertical sliding movement on guide shafts 146, 148, and are fixed to the rear of roller carriage 134. Suitable bushings 154 are provided between bearing blocks 150, 151, 152 and 153 and guide shafts 146, 148 to provide smooth and efficient vertical movement of carriage 134 along the guide shafts.

An additional bearing block 156 is fixed to the lower central portion of the rear of carriage 134, and includes a threaded aperture 158 through which threaded shaft 136 extends. As threaded shaft 136 is rotated by motor 140 and gear train 142, carriage 134 moves vertically on guide shafts 146, 148 as bearing block 156 moves along the threaded shaft.

Figure 6:
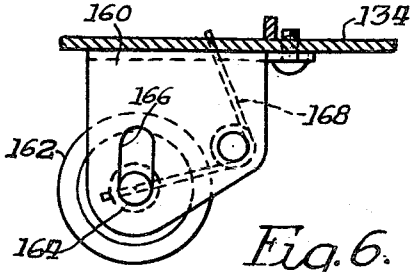
FIG. 6 is a detail view of a document guide roller forming part of the present invention.

A plurality of brackets 160 are mounted in a horizontal row adjacent the top of the outside face of carriage 134. A document transport roller 162 is mounted on each bracket 160 on a shaft 164 about which roller 162 is adapted to rotate. As best seen in FIG. 6, each shaft 164 is mounted in a pair of elongated slots 166 disposed in each bracket 160. A wire spring 168 is attached to each bracket 160 and biases the rollers 162 outward, as viewed in FIG. 2. Rollers 162 are free to move inwardly to the limits of slots 166 under the influence of a document passing through the printing system 10, as will be explained.

Towards the lower edge of the face of carriage 134, a second horizontal row of brackets 170 are mounted to the carriage, whereby each bracket 170 is directly below a corresponding bracket 160. A plurality of document transport rollers 172 are mounted to brackets 170 in exactly the same manner as rollers 162 are mounted on brackets 160, including the provision of an outward spring bias. In the preferred embodiment, rollers 172 are shown with less of a longitudinal dimension than rollers 162, however, this is a matter of engineering choice dependent upon, inter alia, space requirements and the width of belt 116.

Figure 5:
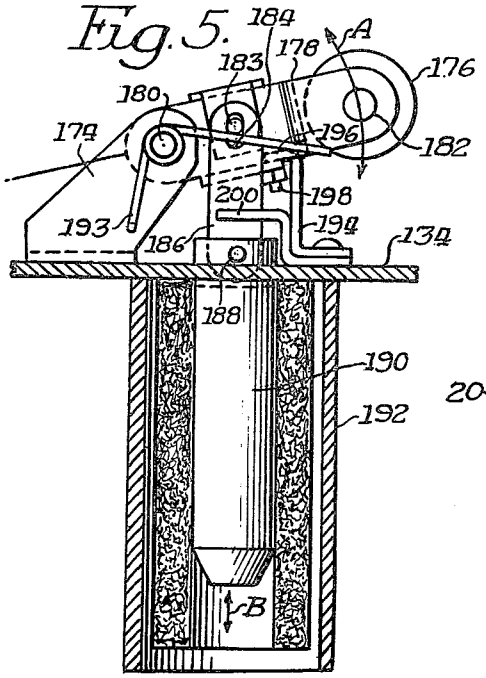
FIG. 5 is a cut-away detail view of the solenoid controlled back-up platen rollers forming part of the present invention.

Also affixed to the front face of carriage 134 intermediate document transport rollers 162 and 172 is a horizontal row of brackets 174 to which a plurality of back-up platen rollers 176 are rotatably mounted. Referring to FIG. 5, each bracket 174 includes a pair of pivot arms 178 extending therefrom which are attached for rotatioh about shaft 180. Platen rollers 176 are mounted for rotation about shafts 182 which are located at the opposite end of each pivot arm 178 from shafts 180.

A pin 183 is attached to the side of each pivot arm 178 and extends through an elongated slot 184 at one end of actuator rod 186. The opposite end of actuator rod 186 is connected by a pin 188 to the piston 190 of solenoid 192. Piston 190 moves in the direction indicated by the arrow B in FIG. 5. A wire spring 193 extends around shaft 180 and engages pin 183 of pivot arm 178 to bias pivot arm 178 and platen rollers 176 in an outward direction. Actuation of solenoid 192 causes each platen roller 176 to move through the limited arc designated by the letter A in FIG. 5. The system is thus self adjustable to automatically accommodate the passage of documents of different thicknesses.

The embodiment shown in FIG. 5 provides an alternate structure for making minute adjustments of the distance of arcuate travel of each platen roller 176 along the path A, which may or may not be required. A bracket 194 is provided having a flange 196 which extends between pivot arms 178. Adjustable screw 198 is attached to pivot arms 178, and abuts flange 196 to limit the outward movement of platen rollers 176 away from carriage 134. A flange 200 is also attached to carriage 134 and is positioned to abut screw 198 to limit the inward movement of platen rollers 176.

Referring to FIGS. 1 and 4, print head carriage 48 and back-up roller carriage 134 are disposed opposite each other to form a path for document 202 (FIG. 1) between the two carriages. Carriage 48 and frame 12 are laterally movable relative to carriage 134 and frame 14 to provide a space between the carriages 48 and 134 to adjust the various elements of the printing system, and to permit the clearance of paper jams (FIG. 4). When printed material is applied to document 202, the two carriages 48, 134 and their respective frames 12, 14 are positioned closely adjacent one another as depicted in FIG. 1. In this latter position, platen rollers 176 are directly opposite appertures 96 in ink guard 92, and opposite print heads 58. When so positioned, the platen rollers act as a back stop for printing wires 66 as they extend from each casing 62 and impact upon ribbon 72 and document 202 during the printing operation. As stated previously, print head 58 contains no means to arrest the movement of pins 66 as they are ballistically propelled forwards during printing, and platen rollers 176 are required to perform this function.

When carriages 48 and 134 are positioned as shown in FIG. 1, document feed belt 114 is directly opposite and adjacent document transport rollers 162, and document feed belt 116 is directly opposite and adjacent document transport rollers 172. Thus, a path for the transport of document 202 to be printed is formed between belt 114 and roller 162, face 94 of ink guard 92 and platen rollers 176, and belt 116 and rollers 172. As is readily apparent, the various rollers on roller carriage 134 are laterally movable and spring biased relative to carriage 48 to provide a path which is self-adjustable for documents of any thickness.

The horizontal movement of movable frame 12 and print head carriage 48 relative to frame 14 and back-up roller carriage 134, respectively, is controlled by a motor 204 which is drivingly connected to a threaded shaft 106 by suitable drive means, such a belt 208, pulley 210 and gear train 211. Threaded shaft 206 is located beneath base plate 24 (FIG. 4) and engages a bearing block 213 having a threaded aperture therein (not shown) which is fixed to frame 12. As shaft 206 rotates, frame 12 moves laterally with respect to frame 14.

Means are provided to limit the pressure that can be applied between the carriages 48 and 134, and their respective components. To this end, an opening 212 is located in base plate 24 immediately above a segment of shaft 206. Walls 214, 216 extend downward and form a part of opening 212. A block 218 having a threaded aperture therethrough is threaded on shaft 206 for lateral movement as shaft 206 rotates, and extends through opening 212. A pair of coil springs 220, 222 extend around shaft 206 beneath opening 212. Spring 220 extends between wall 214 and block 218, and spring 222 extends between wall 216 and block 218. Each spring is adapted to be compressed by movement of block 218 toward wall 214 or 216 under the influence of the rotation of shaft 206. Limit switches 224, 226 are located beneath base plate 24 and are positioned such that block 218 contacts the actuator of one or the other of switches 224, 226 when the block has reached a point where either spring 220 or 222 is applying a pressure of approximately thirty-one pounds per square inch to block 218 in the preferred embodiment. Limit switches 224, 226 are electrically connected to motor 204 whereby the actuation of either limit switch by block 218 causes motor 204 to cut off, thereby stopping further lateral movement of movable frame 12.

As will be explained, limit switch 224 and the location of stop pins 39, 41 control the width of the opening between frames 12 and 14 when the two frames move apart for adjustment, removal of paper jams, or repair of any of the components associated with either frame. As will also be explained, as the two frames 12, 14 move closer together, limit switch 226 and the compression of spring 220 control the maximum amount of pressure that can be applied between belts 114, 116 and document feed rollers 162, 172, and between ink guard 92 and platen rollers 176. In addition, if an operator's hand is caught between the frames 12, 14 as frame 12 is moving towards frame 14, spring 22 will compress and block 218 will actuate limit switch 226 to shut off motor 204 and halt the movement of frame 12 before any injury can occur to the operator.

A primary feature of the disclosed printing system provides that both the printing head carriage 48 and the back-up roller carriage are positioned vertically at the same level independently when the device is adjusted to accommodate the printing of documents of various heights. This is to ensure that document feed rollers 162 and 172 are consistently directly opposite feed belts 114 and 116 respectively, and that platen rollers 176 are consistently opposite wires 66 of print heads 58. The coordinated vertical positioning of carriages 48 and 134 provides the efficiency required for high speed printing.

To provide the above-described mechanically independent coordinated vertical positioning of carriages 48 and 134, impulse generators 132 and 144 produce electrical signals which are directy proportional to the amount of rotation of threaded shafts 42 and 136, respectively. The distance which carriages 48 and 134 move vertically is obviously a function of the amount of rotation of shafts 42 and 136. The electrical signals produced by impulse generators 132 and 144 are transmitted to the central control apparatus (not shown) for printing system 10, which controls motors 128 and 140 in response to the electrical signals relayed to the control. The motors 128 or 140 are correspondingly activated to ensure that the vertical position of the two carriages 48 and 134 remain consistent such that the lines of printing applied to documents of any length are always in the proper location as established by the operator by rotation of vertical control dials on the control panel (not shown).

To provide a means for monitoring the presence of documents as they rapidly enter and leave the printing system 10, an entry photocell pair 228 and an exit photocell pair 230 are located behind suitable apertures in ink guard 92, and adjacent rollers 106 and 110 respectively. Each photocell pair is electrically connected to the control system for the disclosed printing device 10, whereby the speed at which a document is fed into the system, the timing of sequential entry of documents into the system, the timing of the printing operation itself, and the actuation of a document stacking device (not shown) at the exit of the system is controlled responsive to signals originated as photocell pairs 228 and 230 detect the entry and exit of a document from the system.

Prior to operation of the printing system 10, certain adjustments are made. The height of the carriages 48 and 134 is established in accordance with the height of the document 202 to be printed and the desired location of the printed material on the document. The control panel for the system (not shown) preferably includes a suitable dial or display indicator which can be set to a figure representing the desired height location of the printing to be applied to the document. The control for the system then actuates motors 128 and 140 to rotate shafts 42 and 136 simultaneously. Carriages 48 and 134 move up or down together until the pre-programmed position is reached. As print head carriage 48 moves vertically relative to frame 12, square shaft 105 slides in bore 113 of shaft 84, thereby maintaining the power connection between shaft 105 and shaft 84 at all vertical positions of print head carriage 48. Impulse generators 132 and 144 transmit data back to the system control which is used to adjust the degree of rotation of shafts 42 and 136 to ensure that the carriages are properly aligned.

Next, motor 204 is actuated to rotate shaft 206 and drive movable frame 12 towards frame 14 until feed belts 114, 116 and ink guard 92 are in close proximity to document feed rollers 162, 172 and platen rollers 176 respectively. At this point, forward casters 40 approach but do not contact stop pins 39 (FIG. 4). As back-up rollers 176 abut the front surface of ink guard 92, and as rollers 162, 172 abut belts 114, 116, and motor 204 continues to rotate shaft 206, block 218 advances along the threads of shaft 206 against the bias of spring 220. As spring 220 is compressed, movable frame 12 advances slightly until casters 40 contact stop pins 39, and block 218 trips the actuator of limit switch 224 which stops motor 204. The force of spring 220 acting against wall 214 of frame 12 applies and maintains the proper pressure between back-up rollers 176 and ink guard 94, and between rollers 162, 172 and belts 114, 116. Spring 220 is calibrated to maintain the proper pressure between the mechanical components comprising the doucment path, which takes into account the thickness of documents 202 to be transported past printing heads 58.

When motor 204 is rotated in the opposite direction, shaft 206 rotates oppositely and movable frame 12 moves away from stationary frame 14. As casters 40 come into contact with stop pins 41, shaft 206 continues to rotate and block 218 begins to advance along shaft 206 against the bias of spring 222. At the end of its movement, block 218 trips the actuator of limit switch 226, which stops motor 204 and also stops further rotation of shaft 206. Rearward movement of frame 12 is thus halted.

Also, prior to initiating operation of the disclosed printing system, the data base containing the information, such as addresses, to be printed on documents 202 is properly programmed to relay the required sequence of operation to print heads 58. Typically, the data base comprises a character generator program whereby letters and characters in a dot matrix pattern are produced when wires 66 of each print head 58 impinge upon document 202 through ribbon 72. In the disclosed embodiment, six print heads 58 are disclosed, each one vertically displaced on line from the others. In this construction, each print head 58 is capable of producing one line of printing, and the total system is capable of producing up to six lines of printed material.

To initiate the operation of the printing system 10, a document 202 is fed between carriage 48 and 134 by a suitable document feed apparatus. One such document feed apparatus is disclosed in my co-pending application Ser. No. 401,577 filed July 26, 1982, titled "Variable Width Envelope Feeder". As the leading edge of document 202 passes entry photocell pair 228, a signal is transmitted to the electronic control system for the apparatus for envelope tracking. As rollers 106 and 108 rotate, belts 114, 116 are driven in a clockwise direction as viewed in FIG. 1. Document 202 is transported to the left (FIG. 1) in the nip between belts 114, 116 and document transport rollers 162, 172. Each document transport roller 162, 172 is adjacent an intermediate roller 122 to provide a firm, straight transport path for document 202, and to prevent the formation of slack in feed belts 114, 116 as they are moving.

As the leading edge of document 202 passes entry photocell 228, an additional signal is generated which is transmitted to the control mechanism for the printer 10, indicating that a document has entered the system. Encoder disc 126 (FIG. 3) receives timing pulses from entry photocell pair 228. The control mechanism for the apparatus tracks the timing pulses and develops an electronic indication of the location of document 202.

One timing pulse controls the actuation of print heads 58 where, for example, each timing pulse creates one line of type. In the preferred embodiment, document 202 is advanced toward the first print head 58 by means of belts 114, 116. As the portion of the document which is to be printed reaches a point approximately one inch from the first print head 58, as determined by the timing pulse received from entry photocell pair 228, the solenoid 192 adjacent the first print head 58 is de-activated, whereby spring 193 (FIG. 5) causes the first platen roller 176 to extend outward towards the aperture 96 adjacent the first print head 58. Almost simultaneously, first print head 58 receives a signal from the data base, and the proper number of wires 66 are ballistically ejected in sequence through aperture 96 adjacent the first print head 58 to form the letters and characters programmed for the first line of print. Wires 66 impinge upon ribbon 72 and document 202 to form the letters and characters, and are stopped when they impact platen roller 176. Solenoid 192 adjacent the first print head 58 remains de-activated, and platen roller 176 remains adjacent aperture 96 opposite the first print head 58 until the first line of printing on document 202 is completed. After the first line has been completely printed, solenoid 172 adjacent the first print head 58 is activated, withdrawing platen roller 176 from its position closely adjacent aperture 96.

As the document 202 advances under the influence of belts 114, 116, the portion to receive printing approaches the second print head 58, which is vertically staggered in relation to the first print head 58, and which is adapted to imprint the second line of type on document 202. The timing impulses initiated when the leading edge of document 202 passed entry photocell pair 228 are translated by the devices' control mechanism to indicate when the second print head 58 is to start printing. In the preferred embodiment, document 202 is an envelope, and the beginning of the second line of print is to appear directly below the beginning of the first line of print to form part of an address on the envelope.

As document 202 continues to advance, solenoid 192 adjacent second print head 58 is deactivated, and the platen roller 176 associated therewith is rotated into position adjacent the aperture 96 next to second print head 58 under the influence of spring 193. Second print head 58 receives a signal from the data base that document 202 is properly positioned to commence printing the second line of characters and letters, and the proper number of wires 66 are ballistially ejected in sequence through aperture 96 adjacent the second print head 58 to form the letters and characters forming the second line of print. Wires 66 impinge upon ribbon 72 and document 202 to form the second line of printing, and wires 66 are stopped when they impact platen roller 176. Solenoid 192 adjacent the second print head 58 remains deactivated, and platen roller 176 remains adjacent aperture 96 opposite the second print head 58 until the second line of printing on document 202 is completed. After the second line has been completely printed, solenoid 172 adjacent the second print head 58 is activated, withdrawing the associated platen roller 176 from its position closely adjacent aperture 96.

As the document 202 is advanced further through the printing apparatus 10, the above sequence of operations is repeated to print a third, fourth, fifth and sixth line of printing on the document, if required. Each subsequent print head 58 is vertically staggered or offset relative to the preceding print head 58, and produces a separate line of print. As the portion of the document 202 to be printed reaches the appropriate print head 58, the associated solenoid 192 is deactivated and the corresponding platen roller 176 is pivoted into position adjacent aperture 96 to act as a back-up to receive the impact of wires 66 when the print head 58 is actuated. Upon completion of the line of printing applied by each print head 58, the associated solenoid 192 is activated, and the corresponding platen roller 176 is pivoted away from aperture 96.

An important feature of the above-described platen roller mechanism is to provide a means for receiving the impact of ballistically propelled wires 66 when a line of print is being applied to document 202, and at the same time eliminate the potential for interference with the leading edge of the document 202 as it passes through the printing apparatus. The printing operation described above is position sequenced, and it is important for the efficient operation of the apparatus that the document 202 not slip between belts 114 and 116, and rollers 162 and 172. To accomplish these purposes, back-up platen rollers 176 remain in place adjacent apertures 96 and ink guard 92 only when necessary during the printing of each line of address to arrest the continued movement of wires 66, and are withdrawn when the corresponding line has been printed. Thus, the platen rollers 176 remain in the path between carriages 48 and 134 through which document 202 must pass at a working distance only during the printing operation, while maintaining the document at the requisite close range to the print heads.

In addition, the back-up platen rollers 176 rotate under the influence of the rapidly moving document 202. Thus, no or minimal friction is created by the contact between the document 202 during printing and roller platens 176, as contrasted with the friction that would be created if the back-up for wires 66 provided by a stationary element such as a flat bar, for example.

Also, the use of the pivotal platen rollers 176 of the present invention allows the feeding of documents 202 of intermixed thickness through the printing apparatus 10 without the necessity of readjusting the back-up platen rollers 176. The springs 193 associated with each platen roller 176 (FIG. 5) automatically apply an increased force against thicker documents.

As the trailing edge of document 202 passes exit photocell pair 230, a stacking device (not shown) which may be associated with the document feed path of printing apparatus 10 is actuated, and assists in the removal of each document 202 from the apparatus.

During the printing operation, wires 66 of each print head 58 are extended through their respective aperture 96 in ink guard 92. Ribbon 72 is on the side of ink guard 92 opposite document 202, and only the small portion of ribbon 72 which extends through aperture 96 contacts the document. The remaining extent of ribbon 72 stays behind the ink guard and does not come into contact with document 202, thereby preventing streaking and smearing of the document through excessive contact with ribbon 72.

The foregoing detailed description has been given for clearness of understanding only and no unnecessary limitations are to be understood therefrom. Modifications of the present invention may be made by those skilled in the art without departing from the spirit of the invention.

I claim:

1. In a matrix printing apparatus of the type having a path for sequentially transporting a series of documents to be printed between dot matrix ballistic print head means and back-up means oppposite said print head means; transport means for driving each said document along said path; said dot matrix ballistic print head means adapted, when actuated, to simultaneously impact an ink source and one side of each said document as each said document passes said print head means to apply printed material to each said document in a preprogrammed array, said dot matrix ballistic print head means also impacting upon said back-up means when applying printed material to said documents, the improvement comprising means to selectively move said back-up means from a first position immediately adjacent said print head means when said print head means is actuated to apply printed material to said documents, to a second position at a distance from said print head means when said print head means is not actuated, whereby said back-up means is removed from said path when said print head means is not applying printed material to said document to provide a relatively unobstructed path for transporting said documents when said printing head means is not actuated; said back-up means comprising roller means mounted on said apparatus for rotative movement under the influence of said documents as each said document is transported along said path when said back-up means is in said first position and mounted for pivotal movement between said first and second positions under the influence of selectively operable actuator means operably connected to each of said roller means.

2. The matrix printing apparatus of claim 1 wherein said back-up means comprises roller means supported by said apparatus for rotative movement under the influence of each said document as each said document is transported along said path when said back-up means is in said first position, said roller means also mounted for pivotal movement between said first and second positions under the influence of selectively operable actuator means operably connected to said roller means.

3. The matrix printing apparatus of claim 2 wherein said actuator means, when actuated, pivots said roller means to said second position, and wherein said actuator means includes bias means to bias said roller means into said first position when said actuator means is not actuated.

4. The matrix printing apparatus of claim 1 wherein said print head means comprises a plurality of matrix print heads disposed in spaced relation along said path, each said print head adapted to apply one line of printing to each said document as each said document is transported along said path, said back-up means comprising a plurality of rollers mounted on said apparatus, each roller mounted adjacent one of said print heads, and each said roller mounted for rotative movement under the influence of said document as each said document is transported along said path when said back-up means is in said first position and mounted for pivotal movement between said first and second positions under the influence of selectively operable actuator means operably connected to each of said rollers.

5. The matrix printing apparatus of claim 2 including detection means located at the beginning of said path to detect the entry of a document into said path as said document is being transported along said path, control means responsive to a signal generated by said detection means and operably connected to said print head means and said actuator means, whereby the generation of said signal controls the timing of operation of said print head means and said actuator means.

6. The matrix printing apparatus of claim 1 wherein said ink source comprises an endless inked ribbon which continually moves between said dot matrix ballistic print head means and said document path, and including ink guard means disposed between said inked ribbon and said document path, said ink guard having relatively small apertures therein adjacent said print head means wherein only the portion of said ribbon adjacent said print head means extends through said apertures and contacts said document during application of said printing to said document, thereby preventing smearing of said document by portions of said inked ribbon which are not adjacent said print head means.

7. The matrix printing apparatus of claim 6 wherein said ink guard is movably mounted on said apparatus to move between a first position closely adjacent said inked ribbon to a second position away from said inked ribbon whereby adjustments to said inked ribbon and said print head means can be made when said ink guard is in said second position.

8. In a matrix printing apparatus of the type having a path for sequentially transporting a series of documents to be printed between dot matrix ballistic print head means and back-up means opposite said print head means; transport means for driving each said document along said path; said dot matrix ballistic print head means adapted, when actuated, to simultaneously impact an ink source and one side of each said document as each said document passes said print head means to apply printed material to each said document in a preprogrammed array, said dot matrix ballistic print head means also impacting upon said back-up means when applying printed material to said documents, the improvement comprising means to selectively move said back-up means from a first position immediately adjacent said print head means when said print head means is actuated to apply printed material to said documents, to a second position at a distance from said print head means when said print head means is not actuated, whereby said back-up means is removed from said path when said print head means is not applying printed material to said document to provide a relatively unobstructed path for transporting said documents when said printing head means is not actuated, first carriage means mounted on said apparatus on one side of said path and adapted for vertical movement relative to said apparatus, second carriage means mounted on said apparatus on the opposite side of said path from said first carriage means and adapted for vertical movement relative to said apparatus said dot matrix ballistic print head means and said ink source mounted on said first carriage means, said back-up means mounted on said second carriage means, first drive means operably connected to said first carriage means to move said first carriage means in a vertical direction, second drive means operably connected to said second carriage means to move said second carriage means in a vertical direction, control means operably connected to said first and second drive means and including means to selectively operate said drive means to move said first and second carriages vertically to accommodate the printing of various sized documents, whereby the vertical movement of said first and second carriages is coordinated by said control means to ensure that said back-up means are consistently opposite said dot matrix ballistic print head means during the application of printed material to each said document.

9. The apparatus of claim 8 wherein said transport means includes belt means mounted on said first carriage means and adapted to engage and advance each document along said path, said belt means mounted on opposed rotating roller means, said roller means attached to a first shaft means, said first shaft means including a longitudinal core therethrough of a defined cross-sectional shape in the radial plane of said first shaft, said transport means including third drive means having second shaft means driven by said third drive means, said second shaft means having a radial cross-sectional shape corresponding to said defined cross-sectional shape of said core of said first shaft means, said first shaft means adapted to extend over said second shaft means whereby said core of said first shaft means receives said second shaft means and said second shaft means slides in said core as said first carriage means moves relative to said apparatus.

10. The apparatus of claim 9 wherein said third drive means includes motor means mounted on said apparatus, said first carriage means mounted on a frame means, said frame means adapted for movement in a lateral direction relative to said apparatus, first gear means rotatively driven in a given plane by said motor means, second gear means attached to said second shaft means and adapted to rotate in said given plane of rotation as said first gear means, whereby lateral movement of said frame means causes said first and second gear means to mesh and deliver rotative motion from said motor to said second shaft means.

11. In a matrix printing apparatus of the type having a path for sequentially transporting a series of documents to be printed between dot matrix ballistic print head means and back-up means opposite said print head means; transport means for driving each said document along said path; said dot matrix ballistic print head means adapted, when actuated, to simultaneously impact an ink source and one side of each said document as each said document passes said print head means to apply printed material to each said document in a preprogrammed array, said dot matrix ballistic print head means also impacting upon said back-up means when applying printed material to said documents, the improvement comprising means to selectively move said back-up means from a first position immediately adjacent said print head means when said print head means is actuated to apply printed material to said documents, to a second position at a distance from said print head means when said print head means is not actuated, whereby said back-up means is removed from said path when said print head means is not applying printed material to said document to provide a relatively unobstructed path for transporting said documents when said printing head means is not actuated, said apparatus including a first stationary frame, a second movable frame adapted to move laterally relative to said first frame, first carriage means mounted on said second frame, said dot matrix ballistic print head means and said ink source supported by said first carriage means, second carriage means mounted on said first frame, said back-up means supported by said second carriage means, drive means operably connected between said first stationary frame and said second movable frame to move said second frame relative to said first frame.

12. The matrix printing apparatus of claim 11 wherein said drive means includes pressure limit means disposed between said first stationary frame and said movable frame to regulate the amount of pressure applied between said print head means and said back-up means.

13. The matrix printing apparatus of claim 12 wherein said drive means includes threaded shaft means extending between said first and second frame means whereby rotation of said threaded shaft means causes said second movable frame to move laterally relative to said first stationary frame, said drive means including a prime mover operably connected to said threaded shaft means to selectively rotate said threaded shaft means.

14. The matrix printing apparatus of claim 13 wherein said pressure limit means includes block means engaging said threaded shaft means for limited movement as said threaded shaft means is rotated, spring means disposed between said block means and said second movable frame means, limit switch means disposed in spaced relation to said block means and operably connected to said prime mover whereby said block means contacts and actuates said limit switch means as said second movable frame moves toward said first stationary frame to deactivate said prime mover and prevent further movement of said second movable frame means relative to said first stationary frame means when a preselected pressure as determined by said spring means is reached.

15. The matrix printing apparatus of claim 14 wherein said pressure limit means also includes an additional limit switch adapted to be actuated by said block means when said second movable frame moves away from said first stationary frame to limit the movement of said second movable frame away from said first stationary frame.

16. In a matrix printing apparatus of the type having a path for sequentially transporting a series of documents to be printed between a plurality of dot matrix ballistic print head means and back-up means opposite each said print head means, transport means for driving each said document along said path, each of said dot matrix ballistic print head means adapted, when actuated, to simultaneously impact an ink source and one side of each said document as each said document passes said respective print head means to apply printed material to each said document, said ink source comprising an endless inked ribbon which continually moves between said dot matrix ballistic print head means and said document path, ink guard means disposed between said inked ribbon and said document path, said ink guard having relatively small apertures therein adjacent each said print head means wherein only the portion of said ribbon adjacent said respective print head means extends through said apertures and contacts said document during application of said printing material to said document, thereby preventing smearing of said document by portions of said inked ribbon which are not adjacent said respective print head means, said print head means disposed in horizontal spaced relation along said path, each said print head being vertically offset relative to the remaining print heads and adapted to apply one line of printing to each said document as each said document is transported along said path, said ink guard comprising a plate extending across each said print head, said apertures located in said ink guard adjacent each print head whereby said print heads apply printed material to each said document by projecting said inked ribbon through said apertures and into contact with each said document.

17. A matrix printing apparatus for applying printed material to a plurality of documents comprising: first frame means, second frame means located opposite said first frame means, said second frame means being movable laterally with respect to said first frame means, first carriage means mounted for vertical movement on said second frame means, second carriage means mounted for vertical movement on said first frame means, dot matrix ballistic print head means mounted on said first carriage means, an ink source mounted on said first carriage means and extending across said dot matrix ballistic print head means, whereby said dot matrix ballistic print head means, when actuated, simultaneously impacts said ink source and one side of each of said documents as each said document passes said print head means to apply printed material to each said document in a pre-programmed array, endless belt means mounted on said first carriage adapted to transport said plurality of documents across and adjacent said dot matrix ballistic print head means, back-up means mounted on said second carriage means and disposed opposite said dot matrix ballistic print head means to define a path for transporting said documents between said dot matrix ballistic print head means and said back-up means, idler rollers rotatively mounted on said second carriage means opposite said endless belt means to additionally define said document transport path, said back-up means adapted to alternately be projected to a first position closely adjacent said dot matrix ballistic print head means when said print head means is actuated to apply printed material to each said document, and to be withdrawn from said dot matrix ballistic print head means to a second position when said print head means are not applying printed material to each said document.

18. The matrix printing apparatus of claim 17 wherein said dot matrix ballistic print head means comprises a plurality of dot matrix ballisic print heads disposed in spaced relation along said path, each said print head being staggered vertically relative to each adjacent print head whereby each print head applies a separate line of printed material to each said document as each said document is transported along said path.

19. The matrix printing apparatus of claim 18 wherein said back-up means comprises a plurality of platen rollers pivotally and rotatably mounted on said second carriage means, each of said platen rollers located opposite a corresponding one of said plurality of dot matrix ballistic print heads to receive the impact of said corresponding print head during application of printed material to each said document, and actuator means operably connected to each said platen roller to selectively pivot each platen roller between said first and second positions.

20. The matrix printing apparatus of claim 17 comprising first drive means operably connected to said first carriage means to move said first carriage means in a vertical direction, second drive means operably connected to said second carriage means to move said second carriage means in a vertical direction, control means operably connected to said first and second drive means and including means to selectively operate said drive means to move said first and second carriages vertically to accommodate the printing of various sized documents, said control means also including movement detection means to monitor the relative movement of said first and second carriages and coordinate the positions of said first and second carriages to ensure that said back-up means are consistently opposite said dot matrix ballistic print head means during the application of printed material to each said document.

21. The matrix printing apparatus of claim 20 including a first threaded shaft rotatably mounted on said second frame means, drive means to rotate said first threaded shaft, said first carriage means mounted on said first threaded shaft whereby rotation of said first threaded shaft causes said first carriage means to move vertically, a second threaded shaft rotatably mounted on said first frame means, additional drive means to rotate said second threaded shaft, said second carriage means mounted on said second threaded shaft whereby rotation of said second threaded shaft causes said second carriage means to move vertically, first detector means operably connected to said first threaded shaft to monitor the rotation of said first threaded shaft, second detector means operably connected to said second threaded shaft to monitor the rotation of said second threaded shaft, control means operably connected to said first and second detector means, to said drive means and to said additional drive means to rotate said first and second threaded shafts to actuate said respective drive means, to maintain the positions of said first and second carriage means such that said back-up meansis consistently located immediately opposite said dot matrix ballistic print head means.

22. In a printing apparatus of the type having a path for sequentially transporting a series of documents to be printed past a print head means, said print head means adapted to apply printed material to each said document, transport means including drive means for advancing each document along said path, said drive means mounted on a stationary frame of said apparatus, said apparatus including carriage means supporting said transport means, said carriage means adapted for movement in a first direction relative to said stationary frame, said transport means including rotating components which are rotated by said drive means, shaft means having certain of said rotating components attached thereto, said drive means also including a motor mounted on said stationary frame, first gear means driven by said motor and adapted to be rotated in a given plane, second gear means attached to said shaft means and adapted to rotate in said same given plane of rotation as said first gear means, said carriage means adapted for movement in a second direction relative to said stationary frame, whereby movement of said carriage in said second direction causes said first and second gear means to mesh and deliver rotative motion from said motor to said shaft means.

23. The apparatus of claim 22 wherein said shaft means includes a first shaft means having a longitudinal core therethrough of a defined cross-sectional shape in the radial plane of said first shaft, said second gear means attached to a second shaft, said second shaft having a radial cross-sectional shape corresponding to said defined cross-sectional shape of said core of first shaft, said first shaft adapted to extend over said second shaft whereby said core of said first shaft receives said second shaft and said second shaft slides in said core as said carriage means moves relative to said stationary frame.

* * * * *